US012139869B1

(12) United States Patent
Adams

(10) Patent No.: US 12,139,869 B1
(45) Date of Patent: Nov. 12, 2024

(54) METHOD FOR REDUCING EROSION ON HILLSIDES

(71) Applicant: William E. Adams, Portersville, PA (US)

(72) Inventor: William E. Adams, Portersville, PA (US)

( * ) Notice: Subject to any disclaimer, the term of this patent is extended or adjusted under 35 U.S.C. 154(b) by 97 days.

(21) Appl. No.: 16/741,063

(22) Filed: Jan. 13, 2020

(51) Int. Cl.
*E02D 17/20* (2006.01)
*B65D 30/06* (2006.01)
*E02B 3/08* (2006.01)

(52) U.S. Cl.
CPC ..... *E02D 17/202* (2013.01); *B65D 29/04* (2013.01); *E02B 3/08* (2013.01); *E02D 17/205* (2013.01)

(58) Field of Classification Search
CPC ..... E02D 17/202; E02D 17/205; E02D 17/20; E02D 31/00; E02D 31/002; E02D 31/06; E02D 2300/0085; E02D 29/0291; E02B 3/08; E02B 3/04; E02B 3/12; E02B 3/122; E02B 3/127; B65D 29/04; E04D 2013/0813; A01G 13/0256; A01G 13/0268
See application file for complete search history.

(56) References Cited

U.S. PATENT DOCUMENTS 3,374,635 A * 3/1968 Crandall ..... E02B 3/127 405/18
5,211,191 A 5/1993 Brown
5,595,458 A * 1/1997 Grabhorn ..... E02B 3/125 210/170.03
5,941,661 A 8/1999 Ishikura
6,305,876 B1 10/2001 Yoshino et al.
6,493,990 B1 12/2002 Anderson
8,287,728 B2 10/2012 Kania et al.
8,657,529 B2 2/2014 Ohkubo et al.
9,986,698 B2 6/2018 Anderson
(Continued)

FOREIGN PATENT DOCUMENTS

DE 3925353 A1 2/1991
JP 2005054400 A 3/2005
(Continued)

OTHER PUBLICATIONS

California Storm Water Quality Association, "California Stormwater BMP Handbook", Jan. 2003. Page 6. Link: https://www.escondido.org/Data/Sites/1/media/pdfs/Utilities/BMPStreambankStabilization.pdf (Year: 2003).*
(Continued)

*Primary Examiner* — Edwin J Toledo-Duran

(57) ABSTRACT

In a method for reducing erosion on land where moving water has formed at least one rill or gully a plurality of rock-filled mesh bags are placed at selected spaced apart locations in a rill or gulley. The mesh bags have side walls in which there are openings, each opening having a major diameter of between ⅛ inches and ¼ inches and a minor diameter which is less than or equal to the major diameter. For most uses, the mesh bags contain rocks having a size in which a largest diameter of the rock is between ⅜ inch and 1 inch, and the mesh bags weigh between 3 pounds and 4 pounds. Water flowing in the gulley will pass through each mesh bag. The mesh bag reduces the flow rate of the moving water. Larger sizes of stones and bags are used for areas of greater flow.

15 Claims, 4 Drawing Sheets

(56) References Cited

U.S. PATENT DOCUMENTS

2002/0008071 A1* 1/2002 Chinn ..... C02F 1/286 210/660
2002/0090265 A1 7/2002 Merten
2004/0101368 A1* 5/2004 Daigle ..... E02B 3/123 405/15
2005/0254899 A1* 11/2005 Tyler ..... E02D 17/20 405/15
2007/0253785 A1* 11/2007 Tyler ..... A01G 9/0291 405/302.6
2008/0247685 A1* 10/2008 Kim ..... E02B 3/127 405/284
2010/0108617 A1 5/2010 Schmidt et al.
2012/0011773 A1* 1/2012 Cross ..... A01G 9/0291 47/65.8
2012/0117739 A1* 5/2012 Cook ..... E02B 3/127 405/17
2012/0257926 A1* 10/2012 De Giuseppe ..... B29D 28/00 428/220
2012/0257933 A1* 10/2012 De Giuseppe ..... E02D 29/0241 405/258.1
2016/0030867 A1* 2/2016 Love ..... B01D 29/50 210/237
2017/0233969 A1* 8/2017 Hawkinson ..... A01G 13/0268 52/16
2019/0176059 A1* 6/2019 Zock ..... E02B 3/125
2019/0234042 A1* 8/2019 Burkett ..... E02B 3/124
2019/0308801 A1* 10/2019 Marias Albrich ..... B65D 29/04
2020/0080272 A1* 3/2020 Hawkinson ..... E02B 3/04

FOREIGN PATENT DOCUMENTS

JP 2005350929 A 12/2005
KR 20030090246 A 11/2003

OTHER PUBLICATIONS

Nile Basin Initiative, Eastern Nile Subsidiary Action Program (ENSAP), Eastern Nile Technical Regional Office (ENTRO), Eastern Nile Watershed Management Project, "A Field Guide on Gully Prevention and Control", Prepared by Lakew Desta & Belayneh Adugna dated Mar. 2012.
Section SE-6 Gravel Bag Berm from California Stormwater BMP Handbook Nov. 2009.

* cited by examiner

METHOD FOR REDUCING EROSION ON HILLSIDES

FIELD OF INVENTION

The invention relates to a method for reducing erosion on a hillside that is caused by moving water.

BACKGROUND OF THE INVENTION

Erosion is the loss of soil. Soil erosion is a significant environmental problem. The major cause of erosion on hillsides is moving water. Usually rainfall is the source of that water.

When rain falls on a hill, gravity causes the water to flow down the hill. As the speed of the flowing water increases the amount of soil loss increases. Trees and other vegetation that are growing on the hillside resist and slow the downward movement of the water thereby reducing the amount of soil loss and erosion. Consequently, vegetation is often planted on hillsides to reduce erosion. Not only will the grass, fescue and leaves help to slow down raindrops as they fall, the roots of the plants will also help to hold the soil together.

Rain water can infiltrate the soil through pores, as long as they are not saturated. Excess water moves as overland flow ("runoff") down slope and detaches additional soil particles. When runoff is evenly distributed, sheet erosion occurs. Water usually tends to concentrate along the lowest parts of a soil surface and forms small, shallow channels called rills. Overland flow that concentrates in channels leads to the formation of rills and gullies. Rills are small channels, less than 8 inches deep and less than 2 feet wide. Larger channels are known as gullies. If unchecked, rills may extend into the subsoil resulting in gully erosion. FIG. 1 shows a section of a hillside on which rills and gullies have been formed. On farmland these gullies can reduce crop yields, drive up production costs, damage water quality, and even create safety hazards for both people and animals.

Rills are very common in agricultural areas because sustained agriculture depletes the soil of much of its organic content, increasing the erodibility of the soil. Agricultural machines, such as tractors, compact the soil to the point where water flows over the surface rather than seeping into the soil. Tractor wheel impressions often channel water, providing a perfect environment for the generation of rills. If left alone, these rills may erode considerable amounts of arable soil. Some estimates claim rill flow has a carrying capacity of nearly ten times that of non-rill areas. In a moderate rainfall, rill flow can carry rock fragments up to 9 cm in diameter downslope. In 1987, scientist J. Poesen conducted an experiment on the Huldenberg field in Belgium which revealed that during a moderate rainfall, rill erosion removed as much as 200 kg (in submerged weight) of rock. Poesen, J. 1987. "Transport of Rock Fragments by Rill Flow—A Field Study", Catena Supplement 8. W. Germany: Catena Verlag. 35-54.

Farmers and other property owners have a variety of methods available to prevent or reduce erosion. These methods include creating terraces and providing barriers to stop or divert the water away from selected areas.

Diversion structures are sometimes used to control gully erosion. These structures cause water to flow along a desired path and away from areas at high risk for erosion. Diversion structures are constructed above the gully area to direct run-off away from gully heads, and discharge the water into natural waterways or vegetated watercourses, or onto rock outcrops and stable areas which are not susceptible to erosion. Surface water must not be diverted over unprotected areas or it will cause new gullies. The basic aim of diversions is to reduce the surface water entering into the gully through gully heads and along gully edges, and to protect critical planted areas from being washed away.

In gully control, temporary physical structural measures such as gully reshaping, brushwood, sandbag, loose stone, gabion and arc-weir check-dams are used to dissipate the energy of runoff and to keep the stability of the gully. Check-dams are constructed across the gully bed to stop channel/bed erosion. By reducing the original gradient of the gully channel, check-dams diminish the velocity of water flow of runoff and the erosive power of runoff. Run-off during peak flow is conveyed safely by check-dams. Temporary check-dams, which have a life-span of three to eight years, collect and hold soil and moisture in the bottom of the gully. To give vegetation an opportunity to establish, runoff control structures may be needed in the gully. The structures can be either temporary or permanent. The choice of the measures and extent of their use will depend on the amount of the runoff and the status of the gully whether young and actively eroding or mature.

While the use of physical structures to control gully erosion is well-known, the creation and placement of these structures is often time consuming and expensive. Gabion is a wirework container filled with rock, broken concrete, or other material, used in the construction of dams and retaining walls. The cages are typically made of 3-inch mesh and are sold in a range of sizes. The industry standard is 3-foot increments. These containers cost about $35 per cubic yard (a 3-foot-square cage) for standard-gauge galvanized mesh. Because of their size and weight one must either uses a crane or more than one person to place a gabion in a desired location. The best time to stop gully erosion is when the gullies are small. Gabion structures are too large for use in small gullies. While sand bags are available in smaller sizes that weigh less, sandbags block water flow that can result in the formation of a new gulley extending away from the sandbags. Loose stone placed in a gully will either wash away if the stones are small or act a dam if the stones are large.

While the art has focused its efforts on controlling and filling gullies to reduce erosion a better way to reduce hillside erosion is to stop gulley formation. Consequently, there is a need for a method of stopping or preventing gulley formation that is simple, effective and can be implemented by a single person. The method should not require the single person to use cranes or other tools.

SUMMARY OF THE INVENTION

I provide a method for reducing erosion of a hillside that can be easily performed by a single person. The method is simple, yet effective, and is best implemented when a rill is first discovered.

I provide flexible, rock-filled mesh bags that are sufficiently small in size and weight that they can be easily carried by a person of average size and strength. The openings in the mesh bags and the size of the rocks in the bags are selected so the water can pass through the bags but when placed in a rill or gully the speed of the water flowing through the bag will be reduced.

Each opening in the mesh bag has a major diameter of between ⅛ inches and ¾ inches depending on the sizes of rocks enclosed and a minor diameter which is less than or equal to the major diameter. The rocks in the mesh bag preferably have a size in which a largest diameter of the rock is between ¼ and 1.5 inches. Larger rills may need larger stones to allow better erosion control.

The mesh bags can be made of any suitable material including natural materials like hemp or cotton rope or a plastic, such as nylon, polypropylene or polyethylene or reinforced plastic or metal. If the bags will be used in an area where a tractor or other equipment could run over them then a stronger material like nylon should be used. Usually, the top of the mesh bag will be exposed to direct sunlight when the bag is put in place. So the bag should be made of material that is resistant to ultra-violet and other solar radiation. For that reason I prefer to use a material containing a UV stabilizer for making the mesh bags.

The bag must be flexible, so that it conforms to the sides and bottom of the rill. Each bag should contain rocks of different size. The smaller stones will naturally be moved to the bottom of the bag during transport or when in use. There, they will engage the bottom surface of the rill and inhibit further erosion. Flexibility may be provided by putting "pleats" or "wrinkles" in the bag to allow the stones to provide better contact with the earth below and alongside.

I prefer to provide a handle on each mesh bag. The mesh bag may be open at one end and have a draw string around the opening. The draw string will serve as the handle when the bag has been closed. Alternatively, a handle may be sewn or otherwise attached to the mesh bag.

Other details and advantages of my method will become apparent from a detailed description of the method as shown in the drawings.

DESCRIPTION OF PRESENT PREFERRED EMBODIMENTS

Figure 2:
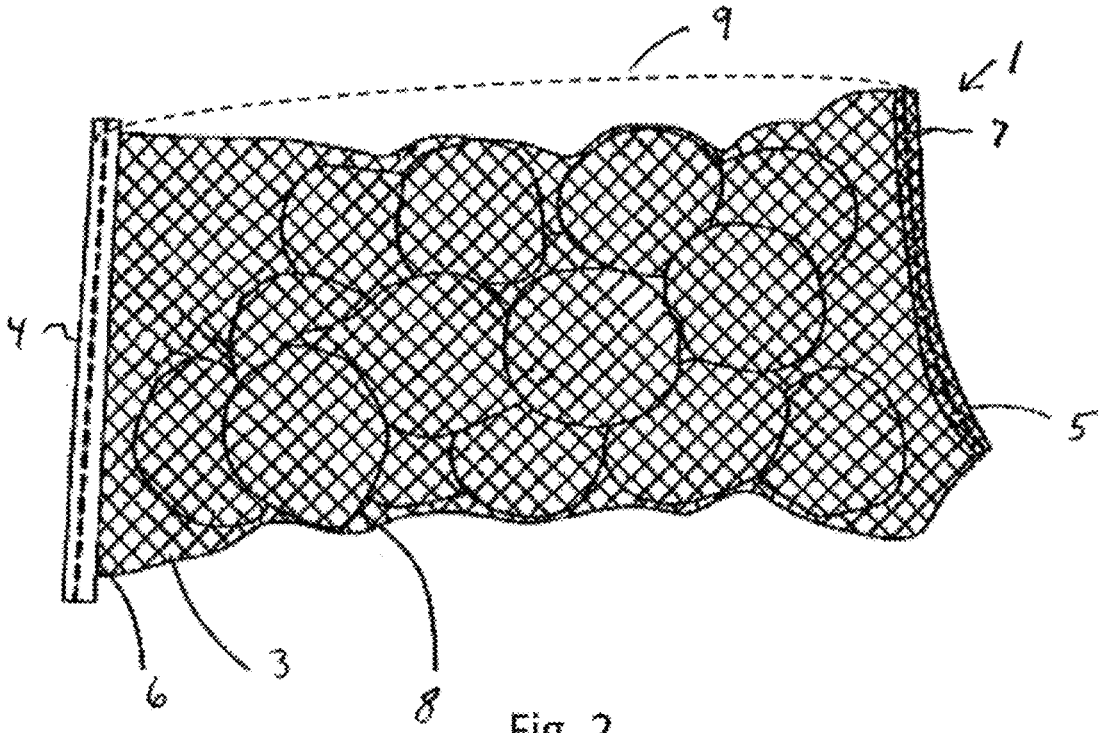
FIG. 2 is a perspective view of a present preferred mesh bag which can be used in my method for reducing erosion on land where moving water has formed at least one rill or gully.
Figure 3:
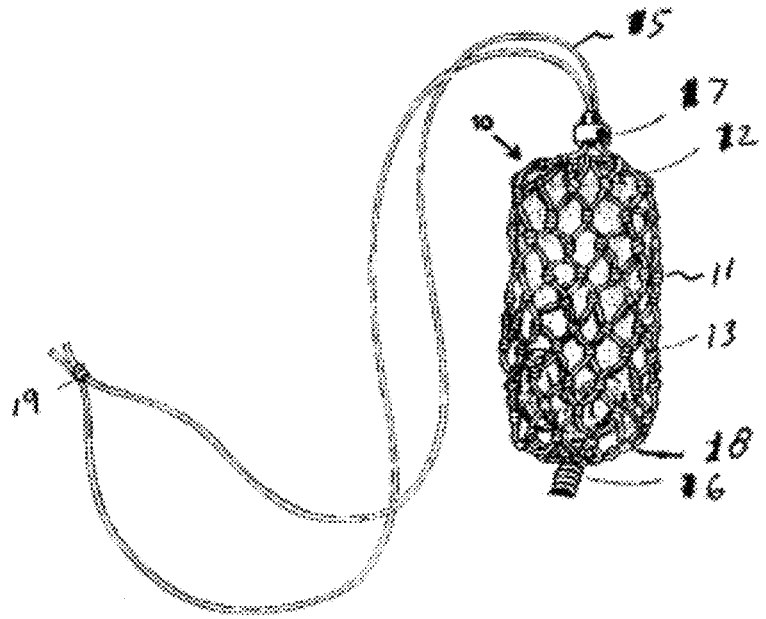
FIG. 3 is a perspective view of another present preferred mesh bag which can be used in my method for reducing erosion on land where moving water has formed at least one rill or gully.

Referring to FIGS. 2 and 3 I provide a mesh bag 1, 10 having side walls 2, 11 in which there are openings 3, 13. Each opening has a major diameter of between ⅛ inches and 1 inches and a minor diameter which is less than or equal to the major diameter. The openings in the mesh bag shown in FIG. 2 are square so the major diameter which can be the height is the same as the minor diameter which is the width. Preferably, the sides of the square openings are ⅜ inches. The openings 13 in the mesh bag 10 are generally diamond shaped and the width is the smaller than the height. So, in this embodiment the height is the major diameter the width is the minor diameter. The openings could be round, oval, square or other polygon shape.

In the mesh bag 1 shown in FIG. 2 the ends 4, 5 of the bag are sewn shut by stitching 6, 7. The mesh bag shown in FIG. 3 is made from a tubular mesh. A closed end is located proximate the bottom portion 18 of the mesh bag 10. The open end is located proximate the top portion 12 of mesh bag 10. The closed end 18 may be formed by gluing, crimping, or knotting the material forming the mesh bag 10. A knot 16 can be seen hanging from the bottom portion 18 of mesh bag 10. In place of knot 16, a crimp bead (not shown) may be used. A drawstring 15 in conjunction with a cinching mechanism 17 interacts with the top portion 18 of the mesh bag 10 for opening and closing the open end 12 of mesh bag 10. Means for securing the ends of the drawstring 15 include a knot or a ring 19 loosely clamped around drawstring. The ring may be made of metal or plastic.

Although my method could be used to control erosion in gullies, the primary goal of the method is to prevent the formation of gullies by placing the rock-filled mesh bags in rills when they are first discovered. These rills may be as small as 2 inches deep and 3 inches wide. For that reason, as well as to permit the bags to be easily carried, I prefer to provide small mesh bags that are 2 inches wide, 4 inches tall and about 1 inch thick and pillow-shaped when laid on a flat surface. One such small mesh bag may be sufficient where the rill is 2 inches deep and 3 inches wide. I also provide larger bags that may be up to 8 inches wide, 12 inches tall and 4 inches thick when laid on a flat surface. The mesh bags can be made of any suitable material including natural materials like hemp or cotton rope or a plastic, such as nylon, polypropylene or polyethylene or reinforced plastic or metal. If the bags will be used in an area where a tractor or other equipment could run over them then a stronger material like nylon or chain metal mesh should be used.

Figure 7:
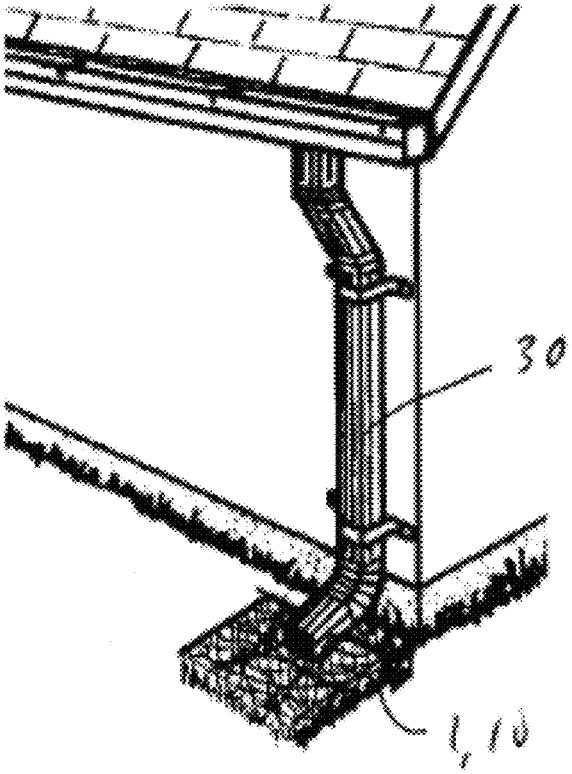
FIG. 7 is a perspective view of my mesh bags placed in a rill that had formed below the end of a downspout on a slope.

The mesh bags for ordinary use are filled with rocks 8 of different size, all having a size in which a largest diameter of the rock is between ⅜ inch and 1.5 inches for most uses. In areas of heavy flow, proportionately larger bags, and stones, may be better utilized. The mesh bags preferably weigh between 3 pounds and 6 pounds. Smaller and larger sizes may be provided for special uses, as at the base of downspouts or larger rills. Sometimes, the ideal "flow-slower" is flat, only an inch or two thick. As shown in FIG. 7, my mesh bags 1 may be put into the ground below a downspout 30. Larger sizes of stones and bags can be used for areas with greater flow.

In the mesh bag shown in FIG. 3 the draw string can be used as a handle. A strip of fabric 9, shown in broken line, can be sewn between the ends of the mesh bag 1 to act as a handle as shown in FIG. 2 or a handle could be attached to one or both ends of the bag.

Figure 4:
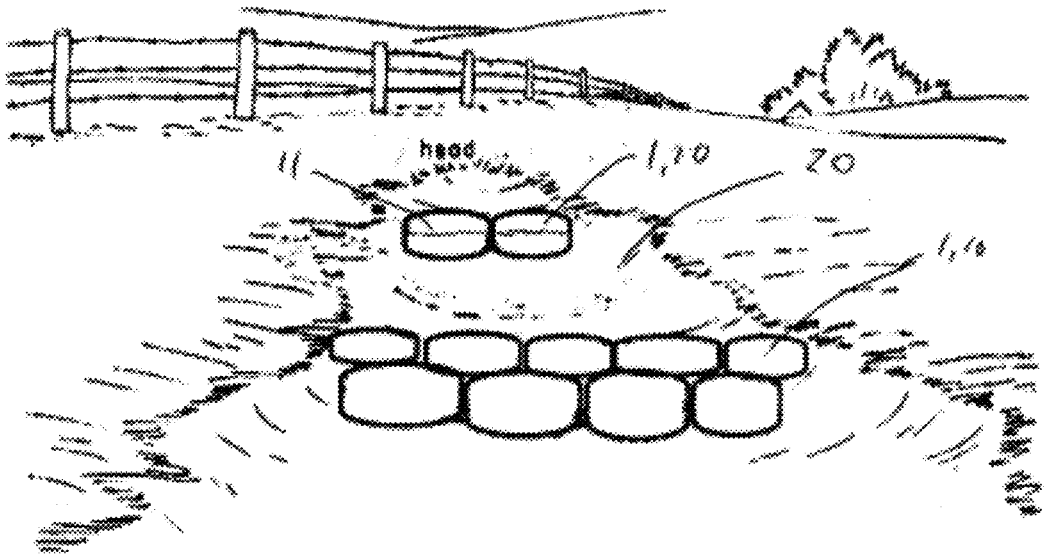
FIG. 4 is a perspective view of a gully in which mesh bags have been placed in accordance with my method.

Preferably when a rill is found the user of my method places one or more mesh bags 1, 10 near the head of the rill 20 as shown in FIG. 4. Then the user places additional bags 1, 10 at spaced apart downstream locations. Some or all of the bags may have a pleat 11 at one or both ends or in the sidewalls (not shown). Some bags may be larger than other bags. FIG. 4 shows smaller bags placed on larger bags at one location. The number of bags that must be placed at each location will depend upon the width, depth, and angle of the rill or gulley at each selected location as well as the size of the bags. The method can also be used for small gullies which have formed from a rill that was not treated using my method.

Because my mesh bags are easy to lift and carry the user does not need any tools to place the mesh bags at desired locations. Mesh bags that are 6 inches tall and 4 inches wide and 1 inch or two inches thick will fit in some jacket pockets and several of them can be carried in a shopping bag or basket. The average farmer or average landowner should be able to carry four or more bags several hundred yards. Consequently, a user is more likely to place my rocked filled mesh bags in a rill or gully when he or she first discovers it and the rill or gully is small. Of course the user could load multiple bags into a wheel barrow or onto a cart attached to a small tractor or riding lawnmower for transport.

Figure 1:
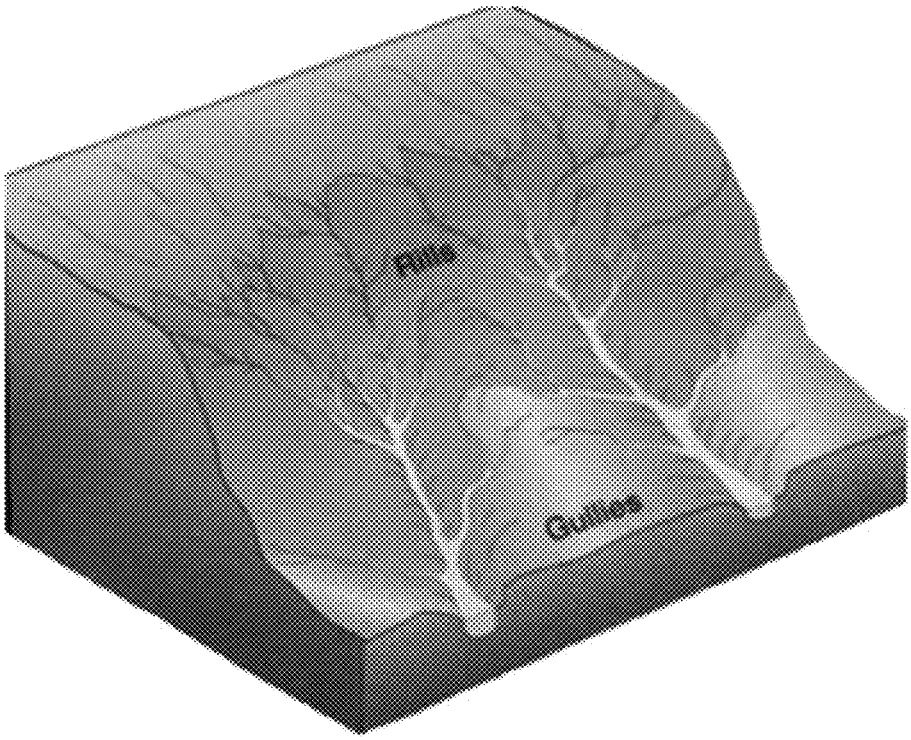
FIG. 1 is a perspective view of a portion of a hillside on which rills and gullies have been formed by water which has flowed down the hill.

The key to effective and lower cost erosion control of hillsides is to place the mesh bags in rills while they are small, before they become gullies. If my mesh bags had been placed in the rills at the top of FIG. 1 when they were first formed then the wide gullies at the bottom of FIG. 1 would not have formed. Even though soil erosion is a significant environmental problem, the art has failed to recognize that slowing water flow in rills is an effective way to prevent or reduce soil erosion. Prior to the present invention farmers and landowners have ignored the rills and waited until gullies have formed before taking action to stop further erosion.

Once in place the mesh bags will allow water to pass through the bag while slowing the flow of the moving water. Consequently, the mesh bags will not act as a dam and cause the moving water to be diverted away from the mesh bags and form a new rill or gully. The mesh material, small size and pillow shape of the mesh bags enables the rock-filled bags to generally conform to the shape of the gully, making it less likely that the bags will roll away from their original location.

I prefer to use smaller rocks and larger rocks in each bag. The smaller stones settle toward the bottom of the bag enabling the bag to conform more closely to the irregular surfaces of the bottom of the rill. That protects it from further erosion caused by water going underneath the bag. When the mesh bag is put into a tiny rill, one only a few inches wide, the mesh bag may have to be extended to lower the height and keep the top of the bag safe from mower blades. This can be done if the mesh bag is partially filled or if the bag is constructed to be expandable. A mesh bag that is ¾ full would allow the installer to manipulate the mesh bag so that it fit snugly in a wider variety of rills. One type of expandable bag may have one or more pleats in the sidewalls. Both the extendable pleated mesh bags and the mostly full mesh bags would allow the user to fit the bag better into the rill and better keep erosion from deepening or widening the rill.

The amount of soil that can be carried by moving water is directly related to the flow rate of the water. When the mesh bags slow the water speed some suspended soil articles will drop to the bottom of the rill or gulley. Over time this deposited soil will build up behind the mesh bags filling in the rill or gully. Because the deposited soil is often rich in nutrients vegetation can easily sprout and grow in the deposit. This new vegetation discourages soil erosion. The stems and leaves help to slow down raindrops as they fall while the roots of the plants help to hold the soil together.

Figure 5:
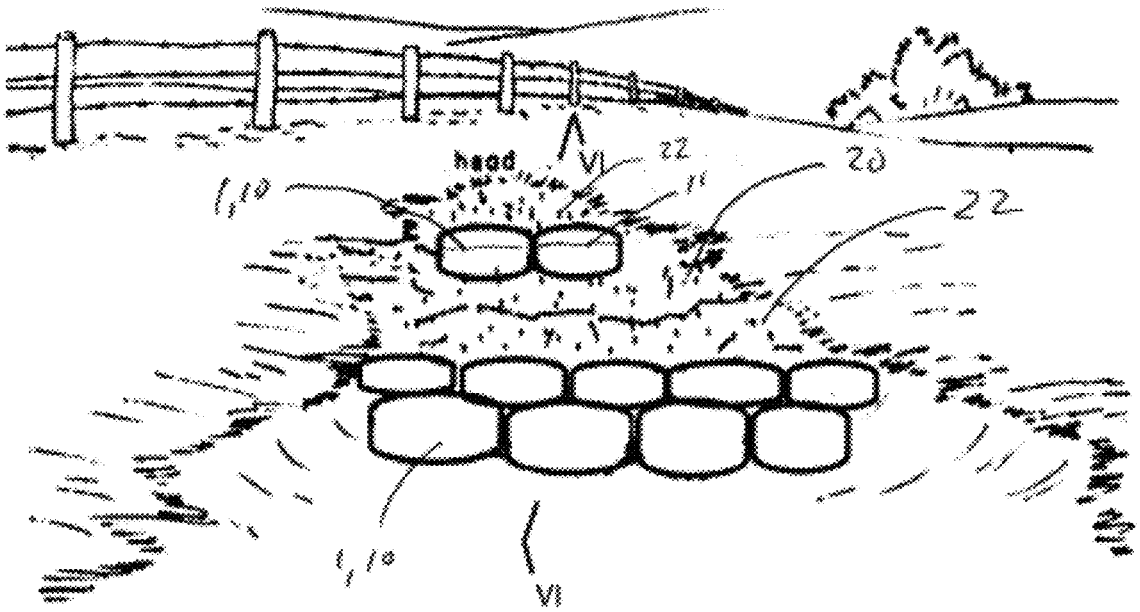
FIG. 5 is a perspective view of the gully shown in FIG. 4 after the mesh bags have been in place for several weeks or months.
Figure 6:
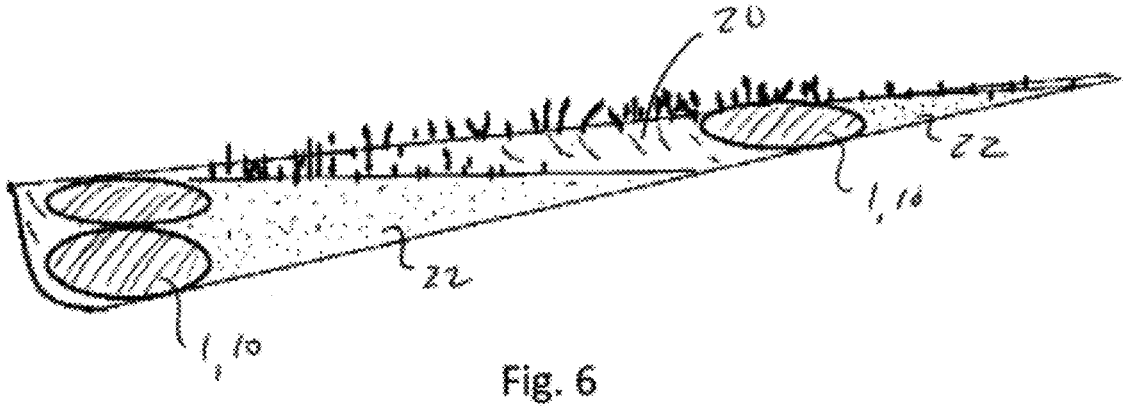
FIG. 6 is a sectional view taken along the line VI-VI in FIG. 5.

FIGS. 5 and 6 show a small gully or rill 20 in which my mesh bags 1, 10 had been placed after several weeks or months. Soil deposits 22 have been created upstream of the bags and grass or other vegetation 24 has sprouted and is growing on the soil deposits.

During the late spring I placed mesh bags in a rill that had formed on a slope in typical soil. This rill was less than a foot wide and 8-10 inches deep near its head. At this location I placed one rectangular bag about 12 inches wide, about 2 inches high and about 2 inches thick. Then I placed an additional, larger bag about 15 feet downstream of this location. There the rill was wider and deeper, having formed a small gulley. After a month, I checked the area and saw that soil had already begun to fill in the gulley upstream of each bag and plants had sprouted in the soil deposits. No new gullies or rills had formed.

It became apparent that the smaller stones settling to the bottom of the bag helped stop future erosion. At the same time, the larger stones in the upper part of the bag were very effective in slowing the water. That protected the downstream portion of the rill from the great erosion that had previously made it much deeper after a few heavy rains.

While my method could be used for large gullies that are several feet wide and over a foot deep, it is not likely that the average landowner or farmer would use the method for that purpose because of the number of bags that would be required for each location and the total number of bags required for the full length of the gully. On the other hand the average landowner or farmer is more likely to use my method than to choose another method to control erosion, or to do nothing, because my mesh bags are easy to carry and place in a rill or small gully.

Although I have shown and described certain present preferred embodiments of my method for reducing erosion it should be distinctly understood that my invention is not limited thereto but may be variously embodied within the scope of the following claims.

I claim:

1. A method for reducing erosion on land where moving water has formed at least one rill, the rill being a channel having a depth of less than 8 inches and a width of less than 2 feet, through which rain water flows comprising:

providing a plurality of mesh bags, the bags having side walls in which there are openings, each opening having a major diameter of between ⅛ inches and ¼ inches and a minor diameter which is less than or equal to the major diameter, the mesh bags containing rocks all having a size in which a largest diameter of the rock is not less than ⅜ inch, and the mesh bags weighing not more than 6 pounds; and placing the mesh bags at selected spaced-apart locations in one rill such that at least one of the mesh bags is spaced apart from all other mesh bags and water flowing in the rill will pass through each mesh bag and continue to flow in the rill, the flowing water having a first flow rate before passing through any selected mesh bag and water that has passed through that mesh bag will flow in the rill at a second flow rate which is less than the first flow rate.

2. The method of claim 1 wherein the mesh bags have a handle attached to at least one sidewall.

3. The method of claim 2 wherein the handle is a drawstring attached to the side walls.

4. The method of claim 1 wherein at least one mesh bag is placed on a slope at the end of a downspout.

5. The method of claim 1 wherein at least one mesh bag is expandable.

6. The method of claim 1 wherein at least one mesh bag is pleated.

7. The method of claim 1 wherein at least one mesh bag is partially full.

8. The method of claim 1 wherein all of the rocks in the mesh bags have a size in which a largest diameter of the rock is between ⅜ inch and 1.5 inches.

9. The method of claim 1 wherein the mesh bags are made from hemp, cotton, metal, plastic or reinforced plastic.

10. The method of claim 9 wherein the plastic is selected from the group consisting of nylon, polypropylene and polyethylene.

11. The method of claim 1 wherein the mesh bags have sufficient strength that the bags will not break when run over by a wheel of a tractor.

12. The method of claim 1 wherein the mesh bags weigh between 3 pounds and 4 pounds.

13. The method of claim 1 wherein the at least one rill has a depth of not greater than 2 inches.

14. The method of claim 1 wherein the at least one rill has a width of not greater than 3 inches.

15. The method of claim 1 wherein the at least one mesh bag is pillow-shaped, 2 inches wide and 4 inches tall.

* * * * *